US010189680B2

(12) United States Patent
Yang et al.

(10) Patent No.: US 10,189,680 B2
(45) Date of Patent: Jan. 29, 2019

(54) LANDING-DOOR DOOR LOCK DEVICE

(71) Applicant: Otis Elevator Company, Farmington, CT (US)

(72) Inventors: Yongtao Yang, Hangzhou (CN); Huanfeng Liu, Hangzhou (CN); Chong Chen, Hangzhou (CN); Hua Zhang, Hangzhou (CN); QingXi Cai, Hangzhou (CN); Junfeng Wu, Hangzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 12 days.

(21) Appl. No.: 15/529,327

(22) PCT Filed: Nov. 13, 2015

(86) PCT No.: PCT/US2015/060668

§ 371 (c)(1),
(2) Date: May 24, 2017

(87) PCT Pub. No.: WO2016/085678

PCT Pub. Date: Jun. 2, 2016

(65) Prior Publication Data

US 2017/0267495 A1 Sep. 21, 2017

(30) Foreign Application Priority Data

Nov. 27, 2014 (CN) ..... 2014 1 0697260

(51) Int. Cl.
*B66B 13/20* (2006.01)

(52) U.S. Cl.
CPC ..... *B66B 13/20* (2013.01)

(58) Field of Classification Search
CPC ..... B66B 13/20; B66B 13/18; B66B 13/16
See application file for complete search history.

(56) References Cited

U.S. PATENT DOCUMENTS 1,765,526 A * 6/1930 Glaser ..... B66B 13/20 187/280
1,816,072 A * 7/1931 Brady ..... B66B 13/20 187/280

(Continued)

FOREIGN PATENT DOCUMENTS

CN 2934169 Y 8/2007
DE 602004008165 T2 5/2008

OTHER PUBLICATIONS

International Search Report and Written Opinion for application PCT/US2015/060668, dated Mar. 1, 2016, 11pgs.

*Primary Examiner* — Michael A Riegelman
(74) *Attorney, Agent, or Firm* — Cantor Colburn LLP

(57) ABSTRACT

The present invention relates to a landing-door door lock device. The following problem is solved: the position of a lock ball of a general landing-door door lock device is not adjustable, and adjustment is complicated when there is a deviation between positions of the lock ball and a door knife. The device includes a primary lock and a secondary lock, the primary lock includes a bottom plate and a locking arm, a counter weight is mounted on the locking arm, a moving ball is fixed onto the counter weight, a fixed ball is mounted on the bottom plate, the secondary lock includes a buckle plate, the locking arm is connected onto the bottom plate through a rotary shaft, an arc-shaped hole is opened on the counter weight, a shaft sleeve is sheathed on a shaft of the fixed ball, the shaft sleeve penetrates into the arc-shaped hole, a front end of the buckle plate is provided with a first lock hook, the locking arm is correspondingly provided thereon with a lock column, and the first lock hook is buckled on the lock column. The present invention has the following advantages: the rotary shaft and the fixed ball are disposed separately, the positions of the fixed ball and the moving ball can be adjusted left and right, when there is a deviation (Continued)

between positions of the lock ball and the door knife of the landing-door door lock device on different floors, it is not necessary to adjust the position of the door lock of the whole floor, so adjustment is simple, and a problem of poor contact occurring in electrical contacts on the door lock is also avoided.

6 Claims, 2 Drawing Sheets

(56) References Cited

U.S. PATENT DOCUMENTS 2,060,283 A * 11/1936 Cullmer ..... B66B 13/20
187/280
2,287,751 A * 6/1942 Fenn ..... B66B 13/20
187/280
3,239,030 A * 3/1966 Anderson ..... B66B 13/20
187/280
3,991,858 A * 11/1976 Westerlund ..... B66B 13/20
187/331
4,149,615 A * 4/1979 Kappenhagen ..... B66B 13/08
187/324
5,730,254 A * 3/1998 Nguyen ..... B66B 13/12
187/325
5,950,766 A * 9/1999 Oberleitner ..... B66B 13/12
187/319
6,021,871 A * 2/2000 Grabner ..... B66B 13/12
187/335
6,220,396 B1 * 4/2001 Heath, III ..... B66B 13/20
187/319
6,474,448 B1 * 11/2002 Zappa ..... B66B 13/20
187/308
7,077,242 B2 * 7/2006 Cocher ..... B66B 13/12
187/330
7,398,862 B2 * 7/2008 Dziwak ..... B66B 13/20
187/319
7,464,794 B2 * 12/2008 Badaoui ..... B66B 13/12
187/319
2003/0070882 A1 * 4/2003 Lauch ..... B66B 13/12
187/309
2005/0139429 A1 * 6/2005 Bisang ..... B66B 13/12
187/319
2006/0243535 A1 * 11/2006 Kinoshita ..... B66B 13/12
187/319
2008/0078628 A1 * 4/2008 Christen ..... B66B 13/12
187/319
2016/0236907 A1 * 8/2016 Zhang ..... B66B 13/12

* cited by examiner

LANDING-DOOR DOOR LOCK DEVICE

TECHNICAL FIELD

The present invention relates to an elevator apparatus, and in particular, to an adjustable landing-door door lock device.

RELATED ART

The existing landing-door door lock device generally includes a primary lock and a secondary lock, a fixed ball and a moving ball of the primary lock are fixed onto a rotary locking arm at the same time, a fixed ball shaft serves as a center of rotation to be fixed with a bottom plate, positions of two lock balls are not adjustable, when there is a deviation between positions of a lock ball and a door knife of the landing-door door lock device on different floors, it is necessary to adjust the position of the whole door lock device, adjustment is complicated, and it is easy to result in poor contact of an electrical contact switch that proves effective closing of the door lock. For example, in a patent of which the number is 201320853687.4 and the title is ELEVATOR LANDING-DOOR DOOR LOCK DEVICE, the device includes an upper sill, a left hanging plate and a right hanging plate slidingly disposed on the upper sill, a left landing door fixedly connected with the left hanging plate, and a right landing door fixedly connected with the right hanging plate, a fixed lock hook is fixedly mounted on the left hanging plate, a movable lock hook capable of turning over is mounted on the right hanging plate through a rotating shaft mechanism, two door balls are mounted on the movable lock hook, wherein one door ball serves as a rotating shaft, the door ball is adjustably fixed onto the bottom plate through a screw and a bolt, and distance adjustment can be carried out, but the two door balls cannot be adjusted separately. Moreover, rotation of the movable lock hook has no limiting structures, and an extreme position limiting function cannot be carried out on the movable lock hook. In addition, position adjustment on the door lock device is adjustment on the whole movable lock hook, which further causes the position of a contact switch mounted thereon and used to detect whether the landing door is closed or not is changed, it is necessary to re-adjust the position of the contact switch, operations are complicated, and a problem of poor contact of the contact switch exists.

SUMMARY OF THE INVENTION

The present invention mainly solves the problem that the position of a lock ball of a general landing-door door lock device is not adjustable, and adjustment is complicated when there is a deviation between positions of the lock ball and a door knife, and provides a landing-door door lock device of which lock balls are adjusted separately and are convenient to adjust.

Another invention objective of the present invention is to provide a landing-door door lock device that implements a function of limiting an extreme position.

The technical solution adopted by the present invention to solve the technical problem thereof is: a landing-door door lock device, including a primary lock and a secondary lock, wherein the primary lock includes a bottom plate and a locking arm, a counter weight is mounted on the locking arm, a moving ball is fixed onto the counter weight, a fixed ball is mounted on the bottom plate, the secondary lock includes a buckle plate, the locking arm is rotationally connected onto the bottom plate through a rotary shaft, a rear end of the locking arm is provided with a first kidney-shaped hole, the counter weight is fixed with the locking arm through the kidney-shaped hole, an arc-shaped hole is opened on the counter weight, a shaft sleeve is sheathed on a shaft of the fixed ball, the shaft sleeve penetrates into the arc-shaped hole, a second kidney-shaped hole is opened on the bottom plate, the fixed ball is fixed with the bottom plate through the kidney-shaped hole, a front end of the buckle plate is provided with a first lock hook, the locking arm is correspondingly provided thereon with a lock column, and the first lock hook is buckled on the lock column. Compared with the existing landing-door door lock, in the present invention, the rotary shaft and the fixed ball are disposed separately, and the fixed ball and the moving ball are both fixed through kidney-shaped holes, so that the positions of the fixed ball and the moving ball can be adjusted separately; in this way, when there is a deviation between positions of the lock ball and the door knife of the landing-door door lock device on different floors, it is not necessary to adjust the position of the door lock of the whole floor, adjustment is simple, and a problem of poor contact occurring in electrical contacts on the door lock is avoided. The counter weight is mounted to the rear end of the locking arm, so that the front end of the locking arm is sticking up all the time, thereby ensuring that the primary lock is always keeping a tightened state with the secondary lock. The arc-shaped hole designed on the counter weight matches the shaft sleeve, which limits swing positions of the locking arm, that is, extreme positions of tightening and opening of the primary lock are limited.

As one preferred solution of the foregoing solution, the landing-door door lock device further includes an interlock hook, the interlock hook includes a mounting plate, a front end of the mounting plate is provided with a second lock hook corresponding to the lock column, and the second lock hook is buckled on the lock column. When the landing door is closed in place, the interlock hook and the primary lock form locking. The interlock hook and the secondary lock form double locking for the landing door.

As one preferred solution of the foregoing solution, a first contact switch head is mounted on the mounting plate, the buckle plate is correspondingly provided thereon with a first contact switch base, and when a landing door is closed in place, the first contact switch head and the first contact switch base are closed with each other. The first contact switch head and the first contact switch base jointly make up a first contact switch, and when the first contact switch is closed, it indicates that the landing door is closed in place.

As one preferred solution of the foregoing solution, a second contact switch head is mounted on a front end of the locking arm, the buckle plate is correspondingly provided thereon with a second contact switch base, and when the door lock device is closed, the second contact switch head and the second contact switch base are closed with each other. The second contact switch head and the second contact switch base jointly make up a second contact switch, and when the second contact switch is closed, it indicates that the door lock device is closed in place.

As one preferred solution of the foregoing solution, the locking arm is provided thereon with two first kidney-shaped holes, the two first kidney-shaped holes are respectively disposed in positions of upper and lower portions of the rear end of the locking arm, an upper portion of the counter weight is connected onto the kidney-shaped hole located on the upper portion through a bolt, the bolt is fixed with the locking arm through a snap spring and a slider nut, the moving ball is correspondingly disposed at the lower portion of the counter weight, the counter weight is connected onto the kidney-shaped hole located on the lower portion through the moving ball, and the moving ball is fixed with the locking arm through a snap spring and a slider nut. The counter weight is fixed with the locking arm through a bolt and the moving ball, and the moving ball adopts a threaded connection manner, which facilitates later replacement of the lock ball. Use of the slider nut better facilitates the counter weight to slide to adjust the position, and at the same time, the snap spring ensures that the slider nut is not disconnected.

As one preferred solution of the foregoing solution, the shaft sleeve is connected onto the kidney-shaped hole of the bottom plate, the shaft sleeve is fixed with the bottom plate through a snap spring and a slider nut, and the fixed ball is in a threaded connection with the shaft sleeve. The fixed ball adopts a threaded connection manner, which facilitates later replacement of the lock ball.

The present invention has the following advantages: the rotary shaft and the fixed ball are disposed separately, and the fixed ball and the moving ball are both fixed through kidney-shaped holes, so that the positions of the fixed ball and the moving ball can be adjusted left and right; in this way, when there is a deviation between positions of the lock ball and the door knife of the landing-door door lock device on different floors, it is not necessary to adjust the position of the door lock of the whole floor, so adjustment is simple, and a problem of poor contact occurring in electrical contacts on the door lock is also avoided.

1—mounting plate 2—first contact switch head 3—first contact switch base 4—buckle plate 5—second contact switch base 6—second contact switch head 7—locking arm 8—rotary shaft 9—bolt 10—counter weight 11—fixed ball 12—moving ball 13—bottom 14—arc-shaped hole 15—shaft sleeve 16—first kidney-shaped hole 17—second kidney-shaped hole 18—first lock hook 19—second lock hook 20—lock column

DETAILED DESCRIPTION OF PREFERRED EMBODIMENTS

The technical solution of the present invention is further described below through embodiments and in combination with the accompanying drawings.

Figure 1:
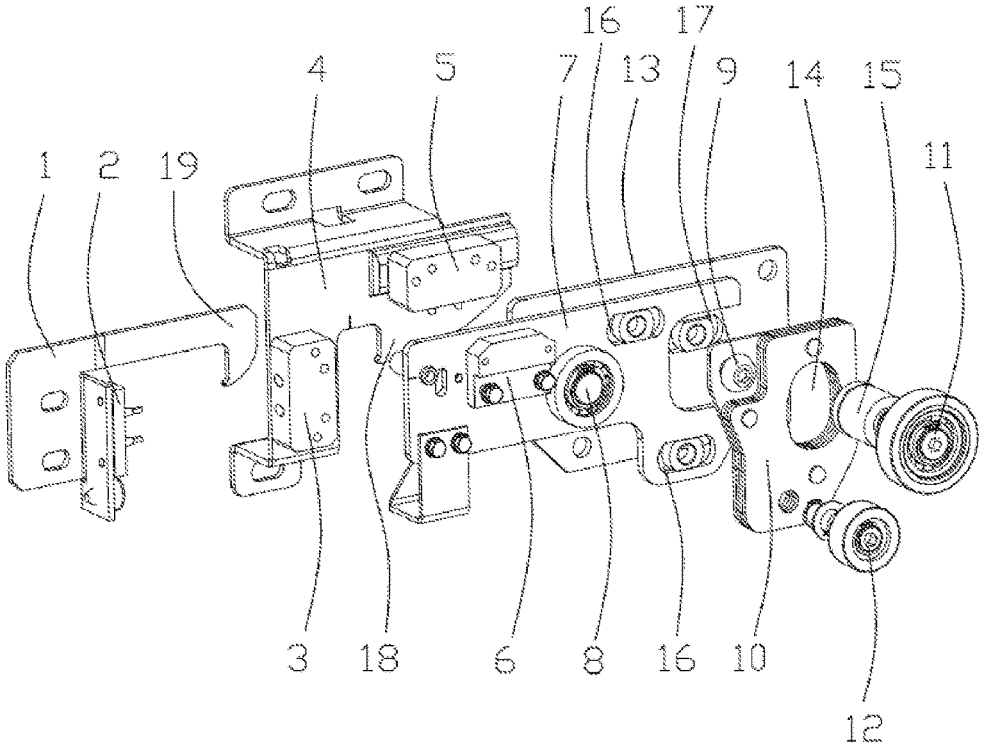
FIG. 1 is a schematic view of an exploded structure of the present invention.

This embodiment provides a landing-door door lock device, which, as shown in FIG. 1, includes three parts, i.e., a primary lock, a secondary lock and an interlock hook. The part of the primary lock includes a bottom plate 13, a locking arm 7, a fixed ball 11, a moving ball 12 and a counter weight 10, the secondary lock includes a buckle plate 4, and the interlock hook includes a mounting plate 1.

The bottom plate is mounted on a landing door, a middle portion of the locking arm is rotationally connected onto the bottom plate 13 through a rotary shaft 8, and the counter weight 10 is mounted onto a rear end of the locking arm. The counter weight is fixed through a bolt 9 and the moving ball 12, a rear end part of the locking arm is provided thereon with two first kidney-shaped holes 16, the two first kidney-shaped holes are respectively disposed in positions of upper and lower portions of the rear end of the locking arm, an upper portion of the counter weight is connected onto the kidney-shaped hole located on the upper portion through the bolt 9, the bolt is fixed with the locking arm through a snap spring and a slider nut, the lower portion of the counter weight is connected onto the kidney-shaped hole located on the lower portion through the moving ball 12, and the moving ball is fixed with the locking arm through a snap spring and a slider nut.

An arc-shaped hole 14 is opened on the counter weight, a groove is opened at a position where the locking arm corresponds to the arc-shaped hole, a shaft sleeve 15 is sheathed on a shaft of the fixed ball, the shaft sleeve penetrates into the arc-shaped hole, a second kidney-shaped hole 17 is opened on the bottom plate, a shaft of the fixed ball penetrates through the arc-shaped hole and the groove on the locking arm to be connected onto the second kidney-shaped hole, and the fixed ball 11 is fixed with the bottom plate 13 through a snap spring and a slider nut.

Figure 2:
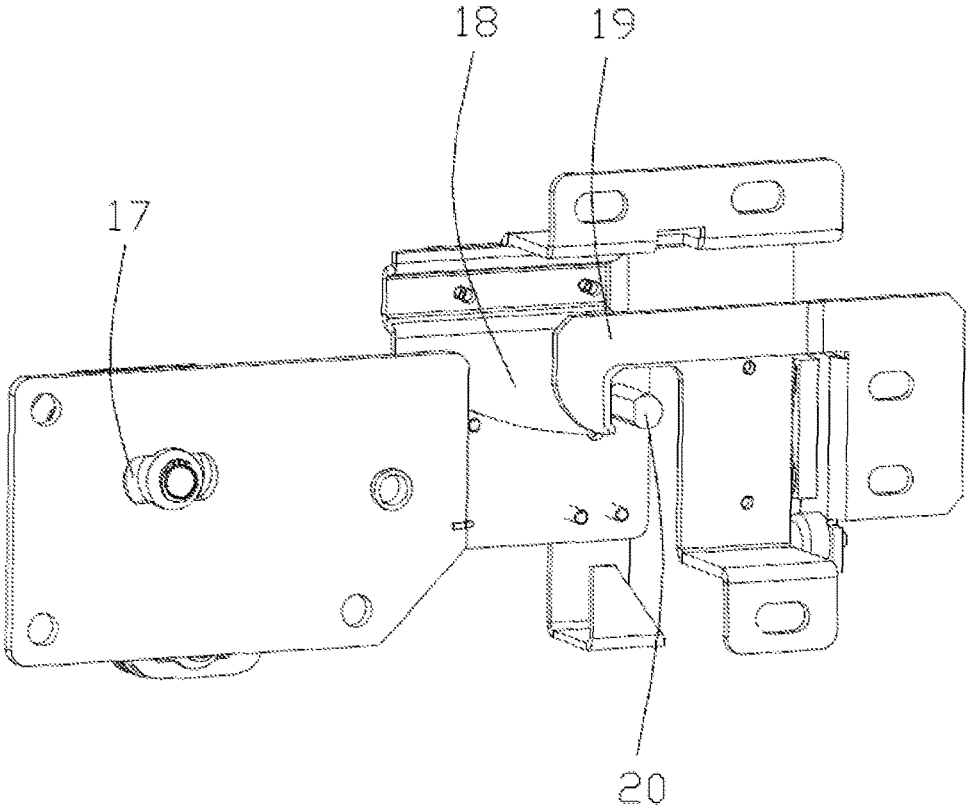
FIG. 2 is a schematic view of a back structure of the present invention.

A front end of the buckle plate is provided with a first lock hook 18, as shown in FIG. 2, the back of the locking arm is correspondingly provided thereon with a lock column 20, and when the door lock device is closed, the first lock hook is buckled on the lock column. A front end of the mounting plate is provided thereon with a second lock hook 19, and when the landing door is closed in place, the second lock hook is buckled on the lock column.

A first contact switch head 2 is mounted on the mounting plate, the buckle plate is correspondingly provided thereon with a first contact switch base 3, and when a landing door is closed in place, the first contact switch head and the first contact switch base are closed with each other. A second contact switch head 6 is mounted on a front end of the locking arm, the buckle plate is correspondingly provided thereon with a second contact switch base 5, and when the door lock device is closed, the second contact switch head and the second contact switch base are closed with each other.

During use of the landing-door door lock device, if there is a deviation between positions of a lock ball and a door knife, it is feasible to respectively adjust the moving ball and the fixed ball separately, and the moving ball is kept penetrated into the arc-shaped hole by adjusting positions of the bolt and the moving ball on the first kidney-shaped hole, adjusting the position of the counter weight left and right and adjusting the position of the moving ball on the second kidney-shaped hole. In this way, positions of the moving ball and the fixed ball have been adjusted, but diameters of the moving ball and the fixed ball are not changed relative to the positions.

Specific embodiments described herein are merely illustrations for the spirit of the present invention. Those skilled in the art can make various modifications or supplements to the specific embodiments described or replace the specific embodiments in a similar manner, which will not depart from the spirit of the present invention or go beyond the scope defined by the appended claims.

Although terms such as primary lock, secondary lock, locking arm and counter weight are used frequently herein, the possibility of use of other terms is not ruled out. Use of the terms is merely intended to describe and explain the essence of the present invention more conveniently; and explaining them as any additional limitation is against the spirit of the present invention.

The invention claimed is:

1. A landing-door door lock device, comprising a primary lock and a secondary lock, wherein the primary lock comprises a bottom plate and a locking arm, a counter weight is mounted on the locking arm, a moving ball is fixed onto the counter weight, a fixed ball is mounted on the bottom plate, and the secondary lock comprises a buckle plate, characterized in that: the locking arm (7) is rotationally connected onto the bottom plate (13) through a rotary shaft (8), a rear end of the locking arm is provided with a first kidney-shaped hole (16), the counter weight is fixed with the locking arm through the kidney-shaped hole, an arc-shaped hole (14) is opened on the counter weight, a shaft sleeve (15) is sheathed on a shaft of the fixed ball, the shaft sleeve penetrates into the arc-shaped hole, a second kidney-shaped hole is opened on the bottom plate, the fixed ball is fixed with the bottom plate through the kidney-shaped hole, a front end of the buckle plate is provided with a first lock hook (18), the locking arm is correspondingly provided thereon with a lock column (20), and the first lock hook is buckled on a first lock column.

2. The landing-door door lock device according to claim 1, characterized by: further comprising an interlock hook, wherein the interlock hook comprises a mounting plate (1), a front end of the mounting plate is provided with a second lock hook (19) corresponding to the lock column, and the second lock hook is buckled on the lock column.

3. The landing-door door lock device according to claim 2, characterized in that: a first contact switch head (2) is mounted on the mounting plate (1), the buckle plate (4) is correspondingly provided thereon with a first contact switch base (3), and when a landing door is closed in place, the first contact switch head and the first contact switch base are closed with each other.

4. The landing-door door lock device according to claim 1 or 2 or 3, characterized in that: a second contact switch head (6) is mounted on a front end of the locking arm (7), the buckle plate (4) is correspondingly provided thereon with a second contact switch base (5), and when the door lock device is closed, the second contact switch head and the second contact switch base are closed with each other.

5. The landing-door door lock device according to claim 1 or 2 or 3, characterized in that: the locking arm (7) is provided thereon with two first kidney-shaped holes (16), the two first kidney-shaped holes are respectively disposed in positions of upper and lower portions of the rear end of the locking arm, an upper portion of the counter weight (10) is connected onto the kidney-shaped hole located on the upper portion through a bolt, the bolt (9) is fixed with the locking arm through a snap spring and a slider nut, the moving ball (12) is correspondingly disposed at the lower portion of the counter weight, the counter weight is connected onto the kidney-shaped hole located on the lower portion through the moving ball, and the moving ball is fixed with the locking arm through a snap spring and a slider nut.

6. The landing-door door lock device according to claim 1 or 2 or 3, characterized in that: the shaft sleeve (15) is connected onto the kidney-shaped hole of the bottom plate, the shaft sleeve is fixed with the bottom plate through a snap spring and a slider nut, and the fixed ball is in a threaded connection with the shaft sleeve.

* * * * *